US008132551B2

(12) United States Patent
Manther

(10) Patent No.: US 8,132,551 B2
(45) Date of Patent: Mar. 13, 2012

(54) SWITCHABLE CAM FOLLOWER OF A VALVE TRAIN ASSEMBLY OF AN INTERNAL COMBUSTION ENGINE

(75) Inventor: Debora Manther, Royal Oak, MI (US)

(73) Assignee: Schaeffler KG, Herzogenaurach (DE)

( * ) Notice: Subject to any disclaimer, the term of this patent is extended or adjusted under 35 U.S.C. 154(b) by 799 days.

(21) Appl. No.: 12/282,706

(22) PCT Filed: Apr. 11, 2007

(86) PCT No.: PCT/EP2007/053495

§ 371 (c)(1),
(2), (4) Date: Sep. 12, 2008

(87) PCT Pub. No.: WO2007/122105

PCT Pub. Date: Nov. 1, 2007

(65) Prior Publication Data

US 2009/0064954 A1 Mar. 12, 2009

Related U.S. Application Data

(60) Provisional application No. 60/745,317, filed on Apr. 21, 2006.

(51) Int. Cl.
*F01L 1/18* (2006.01)

(52) U.S. Cl. ..... 123/90.44; 123/90.39

(58) Field of Classification Search ..... 123/90.44, 123/90.39, 90.45, 90.41, 90.43, 90.42, 90.16; 74/569; 29/888.2

See application file for complete search history.

(56) References Cited

U.S. PATENT DOCUMENTS

| | | | | |
|---|---|---|---|---|
| 5,544,626 | A * | 8/1996 | Diggs et al. | 123/90.16 |
| 5,615,647 | A | 4/1997 | Nielsen | |
| 6,591,798 | B2 * | 7/2003 | Hendriksma et al. | 123/90.16 |
| 6,923,151 | B2 * | 8/2005 | Kreuter | 123/90.16 |
| 6,925,978 | B1 | 8/2005 | Gerzseny | |
| 6,976,461 | B2 * | 12/2005 | Rorig et al. | 123/90.16 |
| 7,308,872 | B2 * | 12/2007 | Sellnau et al. | 123/90.16 |
| 7,328,675 | B2 * | 2/2008 | Seitz et al. | 123/90.39 |
| 7,484,487 | B2 * | 2/2009 | Zurface et al. | 123/90.39 |
| 2003/0209216 | A1 * | 11/2003 | Kreuter | 123/90.16 |
| 2003/0209217 | A1 | 11/2003 | Hendriksma | |
| 2007/0113813 | A1 * | 5/2007 | Lalone | 123/90.44 |

FOREIGN PATENT DOCUMENTS

| | | | |
|---|---|---|---|
| DE | 103 18 295 | A | 11/2004 |
| DE | 10 2004 029555 | A | 1/2006 |

* cited by examiner

*Primary Examiner* — Thomas Denion

*Assistant Examiner* — Daniel Bernstein

(74) *Attorney, Agent, or Firm* — Lucas & Mercanti, LLP

(57) ABSTRACT

A switchable cam follower of a valve train assembly of an internal combustion engine is proposed, with an external lever that encloses an internal lever with its arms, of which components, that can deviate from each other flexibly, run on an axis that is attached to a valve side end, and the internal lever on an underside on the valve side end possesses a mechanism for a gas exchange valve as well as a complementary surface at the other end for storage on a head of a support element. A special characteristic is that guidance plates for the gas exchange valve come out from the underside of the external lever. That way, the switchable cam follower can be made narrower at least on the valve side. In addition, development of the mechanism for the gas exchange valve on the internal lever is simplified.

18 Claims, 1 Drawing Sheet

SWITCHABLE CAM FOLLOWER OF A VALVE TRAIN ASSEMBLY OF AN INTERNAL COMBUSTION ENGINE

This application is a 371 of PCT/EP2007/053495 filed Apr. 11, 2007, which claims the priority of U.S. 60/745,317 filed Apr. 21, 2006, both of which are hereby incorporated by reference.

FIELD OF THE INVENTION

The invention relates to a switchable cam follower of a valve train assembly of an internal combustion engine, with an external lever which encloses an internal lever with its arms, which components, which can move in a pivoting manner relative to one another, run on a common axis that is applied to a valve side end, and the internal lever on an underside on the valve side end possesses a bearing surface for a gas exchange valve as well as a complementary surface at the other end for mounting on a head of a support element, wherein outer and internal levers can be optionally connected to one another via coupling means to achieve a large valve lift, wherein in the event of decoupling a small or 0 valve lift can be represented, wherein at least the external lever has on its upper side at least one stop face for an eccentric disk and wherein the bearing surface is delimited laterally by two guidance plates for the gas exchange valve protruding in the direction of the valve from the cam follower.

BACKGROUND OF THE INVENTION

Such cam followers are sufficiently known to the experts and do not have to be described in greater detail at this point. Therein, the plates for lateral guidance on the valve shaft protrude in the direction of the valve precisely from the lever part with the bearing surface, the internal lever in this case. Due to this formation, the switchable cam follower is unnecessarily wide on the one valve side end. More installation space is thus required and the lever possesses a larger mass. The mass moment of inertia is unnecessarily increased. It also is observed that, due to the guidance plates protruding from the internal lever, machining/finishing of the bearing surface on the underside of the internal lever is made more difficult.

OBJECT OF THE INVENTION

The object of the invention is therefore to create a switchable cam follower of the above-mentioned type in which the cited disadvantages are eliminated.

ACHIEVEMENT OF THE OBJECT

According to the invention, this object is achieved in that the guidance plates run out from the underside of the external lever. These plates should preferably be formed in one piece with the internal lever and their outer sides should be flush with the outer surfaces of the arms of the external lever. The guidance plates on the external lever can possibly also be formed as separate components and connected to the external lever by a suitable connection method such as welding, joining, etc.

Due to the arrangement of the guidance plates on the other component, namely on the external lever, the internal lever and thus the entire cam follower can be formed narrower at least at the valve side end. Less installation space is thus required so that a subsequent installation in cramped cylinder head concepts is also possible. The overall mass of the cam follower can furthermore be reduced. The mass moment of inertia is reduced in comparison to previous designs.

Since the bearing surface for the gas exchange valve is quasi "open" due to the omission of the guidance plates on the internal lever, machining of this surface is significantly simplified.

It is furthermore proposed to produce the lever parts by punching/bending techniques, for example, from steel sheet/steel strip, wherein the protruding guidance plates can be punched out or bent in one operation.

The axis on which the lever parts are to be mounted so as to be movable in a pivoting manner relative to one another runs according to one expedient continuation of the invention directly above the valve shaft. A variant shifted further in the direction of the center of the lever is possibly also conceivable.

It can also be expedient that the axis protrudes with stumps at both ends (in total only one stump is also conceivable and provided) beyond the outer surfaces of the arms of the external lever and that precisely at this protruding region at least one lost motion spring such as a swivel pin spring is applied in a manner known per se. This can represent a further contribution to the "narrow design" of the cam follower on its valve side (in comparison to an installation of the lost motion springs around the axis between outer surfaces of the internal lever and insides of the arms of the external lever or generally within the arms of the external lever).

It is also expedient and provided to form the outer surface of the respective arm with graduated thickness. The smallest thickness thus lies in the region of the valve side.

The stop faces for the large eccentric disks on the external lever are formed as collars protruding outwards from the upper sides of said external lever, which collars thus represent a sliding surface as a contact partner. Alternatively, a roller can be applied here in each case.

In the case of a formation of the cam follower as a lift reversing switch, the internal lever can have a roller as a stop face. A sliding surface can also possibly be applied here.

It is moreover provided according to the invention to form the external lever in a box-like manner so that it is connected by a transverse strap at both ends each. This formation has advantages in terms of rigidity and stability of the external lever. One of the transverse straps can possibly be omitted.

For the particularly preferred case that the arms of the external lever in the region of the other end (support element side) are connected by a transverse strap, this can be engaged from below for coupling by a slide running out longitudinally from the internal lever as a coupling means. This slide runs above the complementary surface of the internal lever for the support element.

Instead of the preferred sheet metal formation of the cam follower parts or at least of one of the arms (possibly except for an insert part with the complementary surface), the cam follower can also be produced by casting techniques. However, it is also conceivable and provided to represent this from a lightweight material such as plastic which is optionally reinforced with fibers or particles.

A particularly narrow cam follower is present when the above-mentioned collars which protrude from the upper side of the arms are omitted and thus only the width of the upper side of the arms is used as a cam stop face.

BRIEF DESCRIPTION OF THE DRAWING

The invention is explained in greater detail with reference to the drawing.

Therein.

DETAILED DESCRIPTION OF THE DRAWING

Figure 1:
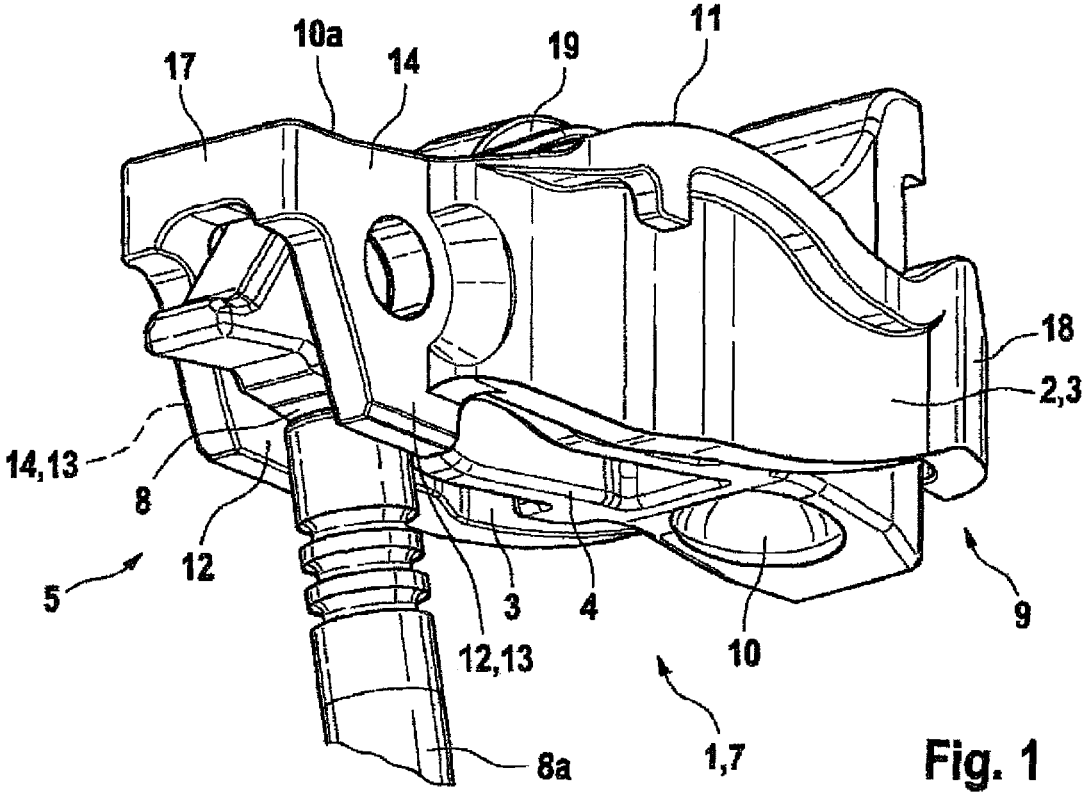
FIG. 1 shows a cam follower according to the invention in a spatial view and FIG. 2 shows the cam follower according to FIG. 1, in a partial section and from a different perspective.

A switchable cam follower 1 of a valve train assembly of an internal combustion engine is shown. This comprises a box-like external lever 2 with two arms 3. Arms 3 are connected at a valve side end 5 and at an opposing other end 9 by in each case a transverse strap 17, 18. External lever 2 encloses an internal lever 4, wherein both levers 2, 4 can move in a pivoting manner relative to one another. To this end, they run on an axis 6 which is applied approximately in the region above a gas exchange valve 8*a*. Axis 6 projects with one stump 15 each beyond external surfaces 14 of arms 3 of external lever 2. Precisely in this region, each stump 15 can be encompassed by a swivel pin spring or the like as a lost motion spring in a manner known per se.

Internal lever 4 has in the region of valve side end 5 on an underside 7 a bearing surface 8 for gas exchange valve 8*a*. At opposing other end 9, internal lever 4 has a complementary surface 10 formed here in a spherical cap shape here for bearing on a head of a support element. Above this complementary surface 10, a slide which can be displaced hydraulically in at least one direction may be provided as a coupling means in internal lever 4.

As is furthermore apparent, internal lever 4 has a roller as a stop face 19 for a low eccentric disk. This is flanked on both sides by sliding surfaces as stop faces 11 on upper sides 10*a* of arms 3 of external lever 2. Stop faces 11 are formed as thin-walled longitudinal collars which protrude outwards and which are preferably connected in one piece with external lever 2. Respective large eccentric disks run against these stop faces 11.

Figure 2:
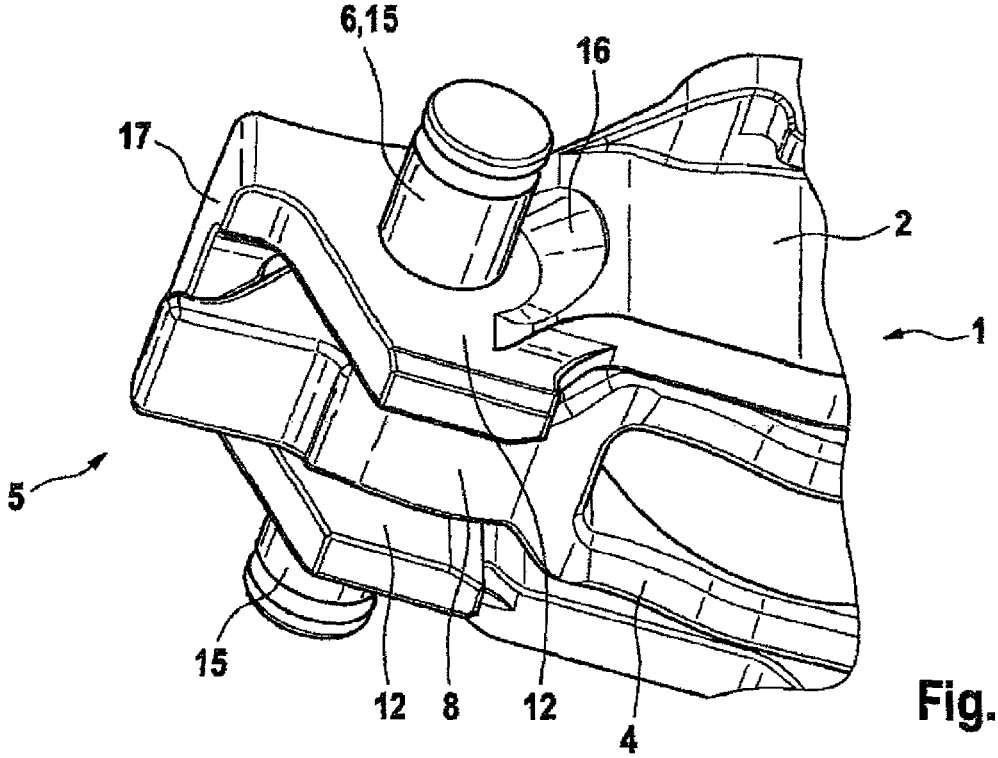

It is also represented that outer surfaces 14 of arms 3 of external lever 2 have graduated thicknesses. They have their smallest thickness in the region of valve side end 5. Behind axis 6, seen in the direction of other end 9, outer surfaces 14 become thicker via a step 16 each. As is apparent in greater detail from FIG. 2, respective step 16 encloses corresponding stump 15 in the manner similar to a half-shell with a small distance.

In each case a guidance plate 12 for the gas exchange valve runs out in one piece from undersides 7 of arms 3 in the region of bearing surface 8 for the gas exchange valve on internal lever 4. Due to this "displacement" of guidance plates 12 from the actual component (internal lever 4) with bearing surface 8 "outwards", cam follower 1 can be designed significantly narrower than previously embodied cam followers at least in the region of valve side end 5. Due to this generally narrower formation, it has a smaller mass and a lower mass moment of inertia. Moreover, "open" bearing surface 8 can more easily undergo finishing (grinding, etc.) on underside 7 of internal lever 4. The manufacturing costs can be reduced as a result.

LIST OF REFERENCE NUMBERS

1) Cam follower
2) External lever
3) Arm
4) Internal lever
5) Valve side end
6) Axis
7) Underside
8) Bearing surface
8*a*) Gas exchange valve
9) Other end
10) Complementary surface
10*a*) Upper side
11) Stop face of external lever
12) Guidance plate
13) Outer side of guidance plate
14) Outer surface of arm
15) Stump
16) Step
17) Transverse strap
18) Transverse strap
19) Stop face of internal lever

The invention claimed is:

1. A switchable cam follower of a valve train assembly of an internal combustion engine, comprising:

an internal lever having a bearing surface on an underside of the internal lever, the bearing surface for a gas exchange valve, the bearing surface at a valve end side of the cam follower, and a complementary surface on the underside of the internal lever, at the other end of the internal lever, for mounting a head of a support element;

an external lever having arms which enclose the internal lever, and at least one stop face for an eccentric disk on an upper side of the external lever;

a shaft transverse to a longitudinal axis of the cam follower and pivotally connecting, the internal lever and the external lever at the valve side end of the cam follower; and two guidance plates for the gas exchange valve protruding in the direction of the valve, the guidance plates extending downward from the underside of the external lever, and the guidance plates delimiting laterally the bearing surface.

2. The cam follower as claimed in claim 1, wherein outer sides of the guidance plates are flush with outer surfaces of the arms of the external lever at the valve side end or run slightly retracted with respect thereto.

3. The cam follower as claimed in claim 1, wherein the guidance plates are formed in one piece with the external lever.

4. The cam follower as claimed in claim 1, wherein the external lever is represented, as seen in the longitudinal direction, with a graduated width or tapering with respectively minimal overall width at the valve side end.

5. The cam follower as claimed in claim 1, wherein the outer surfaces of the arms of the external lever have a smooth surface in the region adjacent to the shaft and, the outer surfaces extend via a step in the manner of a half-shell from the region adjacent the shaft to the end of the support element.

6. The cam follower as claimed in claim 1, wherein the arms of the external lever are connected at one or both ends by a transverse strap.

7. The cam follower as claimed in claim 1, wherein, the internal lever has a stop face for an eccentric disk, the stop face is formed as a roller, and the stop face of the external lever is a sliding surface on the upper sides both arms.

8. The cam follower as claimed in claim 7, wherein, the stop faces on the external lever, protrude as thin-walled longitudinal collars.

9. The cam follower as claimed in claim 7, wherein, the stop faces on the external lever, protrude as thin-walled longitudinal collars.

10. The cam follower as claimed in claim 1, wherein at least one of the external lever or internal lever is produced, at least in sections, by punching/bending techniques from steel sheet or a lightweight material such as plastic or plastic which is reinforced with fibers or particles.

11. The cam follower as claimed in claim 1, wherein the guidance plates are formed in one piece with the external lever.

12. The cam follower as claimed in claim 1, wherein the external lever is represented, as seen in the longitudinal direction, with a graduated width or tapering with respectively minimal overall width at the valve side end.

13. The cam follower as claimed in claim 1, wherein the outer surfaces of the arms of the external lever have a smooth surface in the region adjacent to the shaft and, the outer surfaces extend via a step in the manner of a half-shell from the region adjacent the shaft to the end of the support element.

14. The cam follower as claimed in claim 1, wherein the arms of the external lever are connected at one or both ends by a transverse strap.

15. The cam follower as claimed in claim 1, wherein, the internal lever has a stop face for an eccentric disk, the stop face is formed as a roller, and the stop face of the external lever is a sliding surface on the upper sides both arms.

16. The cam follower as claimed in claim 1, wherein at least one of the external lever or internal lever is produced, at least in sections, by punching/bending techniques from steel sheet or a lightweight material such as plastic or plastic which is reinforced with fibers or particles.

17. A switchable cam follower of a valve train assembly of an internal combustion engine, comprising:

an internal lever having a bearing surface on an underside of the internal lever, the bearing surface for a gas exchange valve, the bearing surface at a valve end side of the cam follower, and a complementary surface on the underside of the internal lever, at the other end of the internal lever, for mounting a head of a support element;

an external lever having arms which enclose the internal lever, and at least one stop face for an eccentric disk on an upper side of the external lever;

a shaft transverse to a longitudinal axis of the cam follower and pivotally connecting the internal lever and the external lever at the valve side end of the cam follower; and two guidance plates for the gas exchange valve protruding in the direction of the valve, the two guidance plates extending downward from the underside of the external lever, and the two guidance plates delimiting laterally the bearing surface, the shaft protrudes through the cam follower in a region above the bearing surface and protrudes with one stump each beyond outer surfaces of the arms of the external lever, wherein at least one stump is enclosed by a swivel pin spring as a lost motion spring.

18. The cam follower as claimed in claim 1, wherein outer sides of the guidance plates are flush with the outer surfaces of the arms of the external lever at the valve side end or run slightly retracted with respect thereto.

* * * * *